US006339319B1

(12) United States Patent
Clapp, III

(10) Patent No.: US 6,339,319 B1
(45) Date of Patent: Jan. 15, 2002

(54) CASCODED CURRENT MIRROR CIRCUIT

(75) Inventor: John S. Clapp, III, Wyomissing, PA (US)

(73) Assignee: Agere Systems Guardian Corp., Allentown, PA (US)

( * ) Notice: Subject to any disclaimer, the term of this patent is extended or adjusted under 35 U.S.C. 154(b) by 0 days.

(21) Appl. No.: 09/628,545

(22) Filed: Jul. 28, 2000

(51) Int. Cl.[7] ..... G05F 3/16
(52) U.S. Cl. ..... 323/315
(58) Field of Search ..... 323/313, 315, 323/316; 330/257, 288; 327/530, 534, 538

(56) References Cited

U.S. PATENT DOCUMENTS 4,525,683 A * 6/1985 Jason ..... 330/288
5,373,253 A * 12/1994 Bailey et al. ..... 330/228
5,917,349 A * 6/1999 Nguyen ..... 327/108
6,011,427 A * 1/2000 Cargill ..... 327/538

* cited by examiner

*Primary Examiner*—Matthew Nguyen

(57) ABSTRACT

An emitter or source follower is added to a current mirror and, more particularly, to a cascoded current mirror that uses beta helpers to reduce the mirror error due to base currents for restoring a Vbe of voltage compliance to the cascoded current mirror, thus allowing the use of a cascoded current mirror in applications where it could not otherwise be used due to voltage compliance problems.

32 Claims, 5 Drawing Sheets

$V_{CC}$
$V_{EE}$
$I_0$
$I_1$
$Q_1$
$Q_2$
$Q_3$
$Q_4$
$Q_5$
$Q_6$
$Q_7$
11
12
15
16
19
21
26
29
30
35
36
38
40
41

$V_{CC}$
$V_{EE}$
$I_0$
$I_1$
$Q_1$
$Q_2$
$Q_3$
$Q_4$
$Q_5$
$Q_6$
$Q_7$
10
12
14
16
18
20
22
24
26
28
30
32
34
36
37
38

CASCODED CURRENT MIRROR CIRCUIT

BACKGROUND OF THE INVENTION

1. Field of the Invention

This invention relates generally to current mirror circuits and more particularly to transistor current mirror circuits used in analog integrated circuit devices.

2. Description of Related Art

Transistor current sources used in analog integrated circuits are generally well known. Typically, such circuits have been utilized as biasing elements and as load devices for amplifier stages. The use of current sources in biasing can result in superior insensitivity of current performance to power-supply variations and to temperature. Furthermore, current sources are frequently more economical than resistors in terms of the die area required to provide bias current of a certain value, particularly when the value of the bias current required is relatively small. When used as a load element in transistor amplifiers, the high incremental resistance of the current source results in high voltage gain at low power supply voltages.

One type of known current source comprises a current mirror and is commonly used in both junction and field effect semiconductor technology. In its simplest form, a current mirror circuit consists of a resistor and two transistors whose currents are constantly proportional to one another. In order to provide a more accurate current source which is less susceptible to variations in output current and changes in supply voltages, cascoded current mirrors were developed. However, as is well known, cascoded current mirrors require more headroom, i.e., more voltage compliance for achieving a desired operating range, than simple current mirrors. Accordingly, well known beta helper circuitry was then added to reduce base current errors; however this type of circuitry increases the headroom requirement even more.

SUMMARY

Accordingly, it is an object of the present invention to provide an improvement in circuitry used in connection with analog integrated circuit architecture.

It is another object of the present invention to provide an improvement in analog integrated circuit current sources.

It is yet another object of the invention to provide an improvement in the type of transistor current sources known as current mirrors.

And it is yet still another object of the invention to provide an improvement in cascoded current mirror circuits.

These and other objects are achieved by the addition of an emitter follower to a current mirror and, more particularly to a cascoded current mirror that uses beta helpers to reduce the mirror error due to base currents for restoring a Vbe of voltage compliance to the cascoded current mirror, and thus allows the use of a cascoded current mirror in applications where it could not otherwise be used due to voltage compliance problems.

In its broadest aspect, the invention is directed to a current mirror circuit, comprising: at least two semiconductor devices, and preferably two pairs of cascoded semiconductor devices, such as transistors, having first and second current conducting electrodes and a control electrode, connected together in a current mirror circuit configuration, wherein the control electrodes thereof are commonly connected together, the first current conducting electrodes being directly connected to a first supply voltage terminal and the second current conducting electrodes being connected to a second supply voltage terminal through respective electrical impedance elements for providing a reference or input current through one of said semiconductor devices and an output current through the other of said semiconductor devices and wherein the reference current and the output current mirror each other and have a constant ratio; a third and a fourth semiconductor device, each having first and second current conducting electrodes and a control electrode, connected between said at least two semiconductor devices to improve the voltage compliance thereof, wherein the control electrode of the third semiconductor device is connected to the second current conducting electrode of said one semiconductor device, wherein one of said first and second current conducting electrodes of the third semiconductor device is directly connected to the first supply voltage terminal, and the other of said first and second current conducting electrodes of said third semiconductor device is connected to the second supply voltage terminal through a load impedance and directly to the control electrode of the fourth semiconductor device, and wherein one of said first and second current conducting electrodes of the fourth semiconductor device is directly connected to the second supply voltage terminal and the other of said first and second current conducting electrodes of the fourth semiconductor device is connected to the first supply voltage terminal through a load impedance and directly to the control electrodes of said at least two semiconductor devices.

Further scope of applicability of the present invention will become apparent from the detailed description provided hereinafter. It should be understood, however, that the detailed description and specific examples, while indicating the preferred embodiments of the invention, are presented for purposes of illustration only, since various changes, alterations and modifications coming within the spirit and scope of the invention will become apparent to those skilled in the art from this detailed description.

BRIEF DESCRIPTION OF THE DRAWINGS

The present invention will be more fully understood when considered in conjunction with the accompanying drawings which are provided by way of illustration only, and thus are not limitative of the present invention, and wherein.

DETAILED DESCRIPTION OF THE INVENTION

Figure 1A:
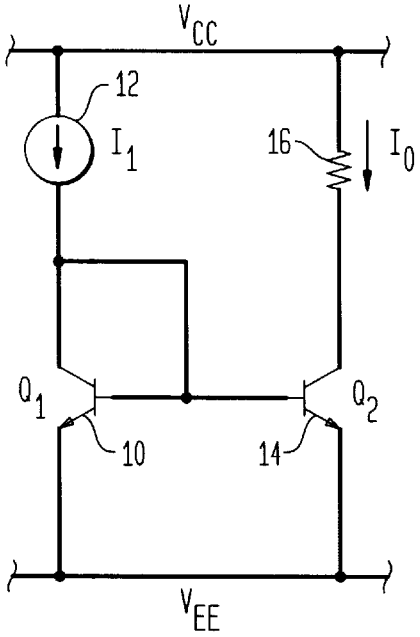
FIG. 1A (PRIOR ART)
FIGS. 1A and 1B are electrical schematic diagrams illustrative of conventional complementary type simple current mirror circuits.
Figure 1B:
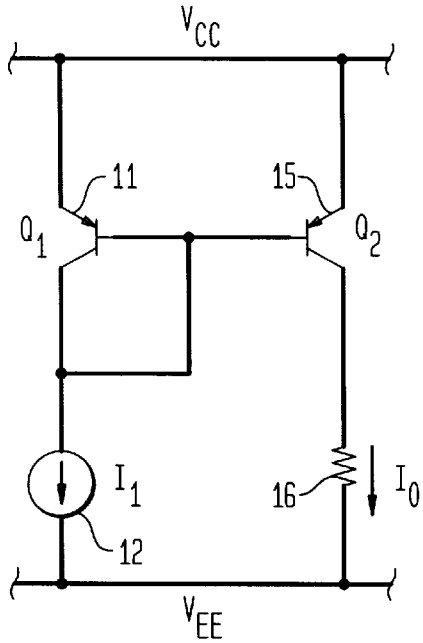
FIG. 1B (PRIOR ART)

Referring now to the drawings wherein like reference numerals refer to like parts throughout, FIGS. 1A and 1B respectively depict npn and pnp semiconductor embodiments of a simple current mirror circuit which is generally well known to those skilled in the art of integrated circuit and semiconductor technology. Reference numeral 10, for example, denotes a first npn transistor Q1 connected between voltage supply source rails $V_{cc}$ and $V_{ee}$ via a collector load impedance 12 which causes a reference current or input current $I_1$ to follow and thus is considered an $I_1$ current source. The base and collector of transistor Q1 is diode connected, forcing the collector-base voltage to zero. The base of Q1 is connected to the base of a second npn transistor Q2, denoted by reference numeral 14, whose collector is connected to $V_{cc}$ via a load resistor 16, providing an output current $I_0$ therethrough. Further as shown, the emitter electrodes of both Q1 and Q2 are connected to the $V_{ee}$ rail. Ground potential may also be substituted for $V_{ee}$ when desirable.

FIG. 1B is a complementary pnp transistor embodiment of FIG. 1A and simply involves a required reversal of polarity connections which is conventional.

In a current mirror circuit which is implemented, for example, on a die of an integrated current structure, the output current $I_0$ is proportional to the input current $I_1$ being dependent upon the ratio of the respective emitter areas A1 and A2 of transistors Q1 and Q2 on the die, such that:

$$\frac{I_O}{I_1} = \frac{A_2}{A_1}$$

Thus for the case of identical devices Q1 and Q2, the output current $I_0$ and reference/input current $1_1$ are equal. Actually, the devices need not be identical; the emitter areas of Q1 and Q2 can be made different, which will cause the current values $I_0$ and $I_1$ for the two transistors to be different. The two currents, however will have a constant ratio. This ratio can be either less than or greater than unity, and thus any desired output current $I_0$ can be derived from a fixed reference current, $I_1$.

Figure 2A:
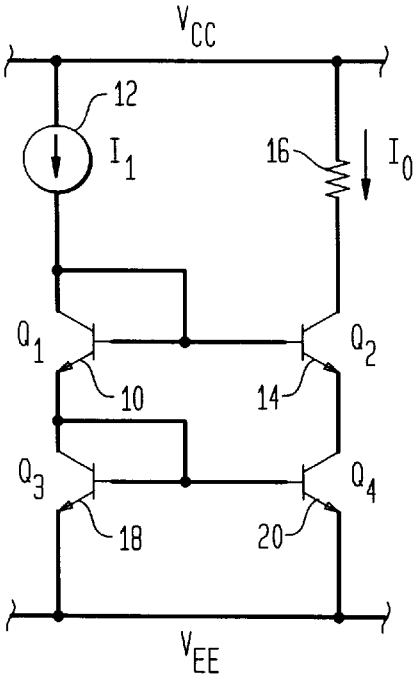
FIG. 2A (PRIOR ART)
FIGS. 2A and 2B are electrical schematic diagrams illustrative of conventional complementary type cascoded current mirror circuits.
Figure 2B:
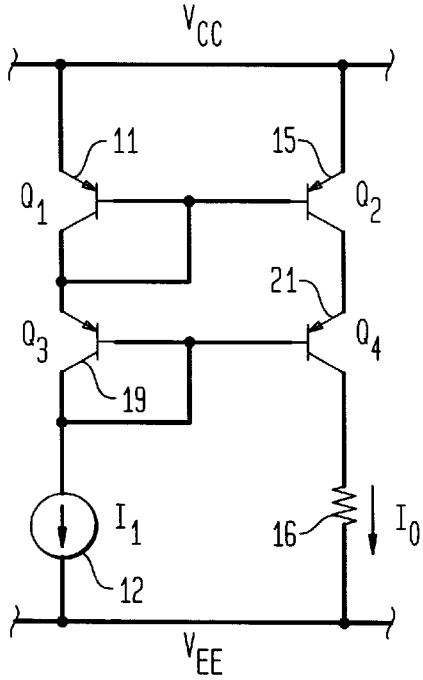
FIG. 2B (PRIOR ART)

Referring now to FIGS. 2A and 2B, shown thereat are npn and pnp embodiments of a cascoded current mirror and which are also well known to those skilled in the art. As shown in FIG. 2A, a third npn transistor Q3 shown by reference numeral 18 is series connected to transistor Q1. Transistor Q3 is also diode connected. A fourth npn transistor Q4 shown by reference numeral 20 is also series connected to transistor Q2.

With respect to the complementary circuit configuration of FIG. 2B, a third pnp transistor Q3 shown by reference numeral 19 is connected in series to Q1. In a like manner, a fourth pnp transistor Q4 shown by reference numeral 21 is series connected to transistor Q2 consisting of pnp transistor 15.

The cascoded current mirror configurations provide a circuit which is not only more accurate, but is less susceptible to variation in output current $I_0$ with respect to changes in $V_{cc}$. Such circuitry, however, involves twice as many transistors and thus involves a loss of $V_{be}$ of voltage compliance due to the additions of transistors Q3 and Q4.

Figure 3A:
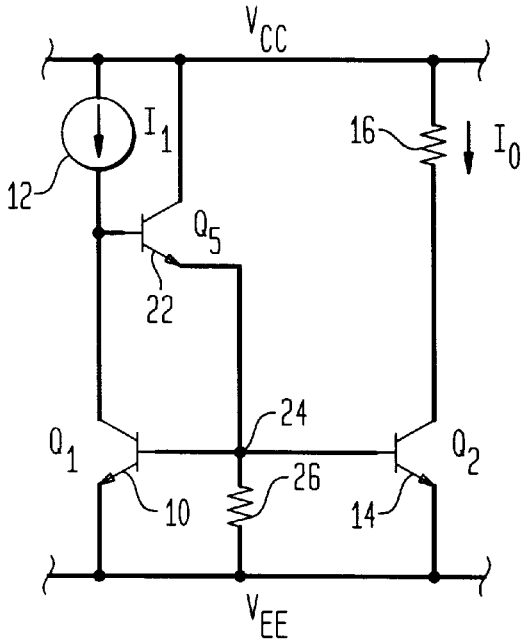
FIG. 3A (PRIOR ART)
FIGS. 3A and 3B are electrical schematic diagrams of conventional complementary type simple current mirror circuits including beta helper circuitry.
Figure 3B:
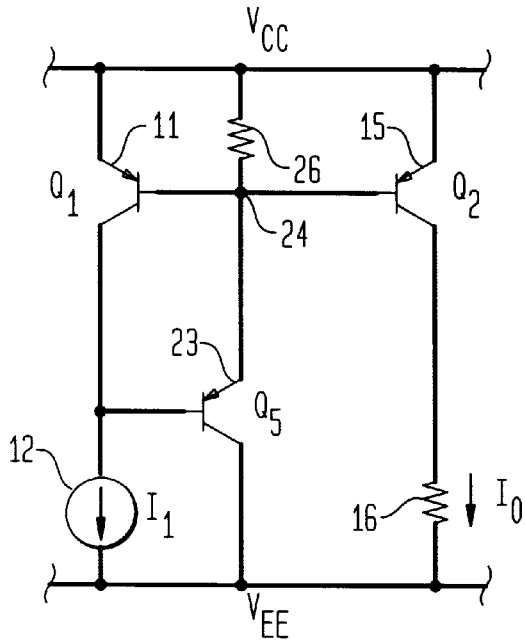
FIG. 3B (PRIOR ART)

In an effort to reduce base current errors in current mirror circuitry utilizing diode connected transistors Q1 and Q3 such as shown, for example, in FIGS. 1A, 1B and 2A, 2B, the prior art has resorted to the inclusion of a beta helper circuit shown, for example, in FIGS. 3A and 3B including a transistor Q5 coupled between the collector and base junction of transistor Q1. In FIG. 3A, this takes the form of an npn transistor 22 connected across the collector-base junction of npn transistor 10, while in FIG. 3B, it comprises the inclusion of a pnp transistor 23, having its base-emitter junction connected across the base-collector junction of pnp transistor 11.

Further, the emitter of beta helper transistor Q5 of FIG. 3A is commonly connected to the base electrodes of transistors Q1 and Q2 at circuit node 24, with circuit node 24 being connected to the $V_{ee}$ rail via emitter load resistor 26. In the complementary circuit of FIG. 3B, the emitter resistor 26 of transistor Q5 is now returned to the supply rail $V_{cc}$ Beta helper circuitry provides more accuracy by reducing the base current errors inherent in the simple and cascoded current mirror configurations. However, it results in the addition of still another transistor element. The $V_{be}$ voltage drop across transistor Q5 limits the voltage swing of $I_1$ and the voltage at $I_1$ current source 12 cannot be any higher than $V_{cc}-2V_{be}$ for the circuits to operate correctly for FIG. 3B.

Figure 4A:
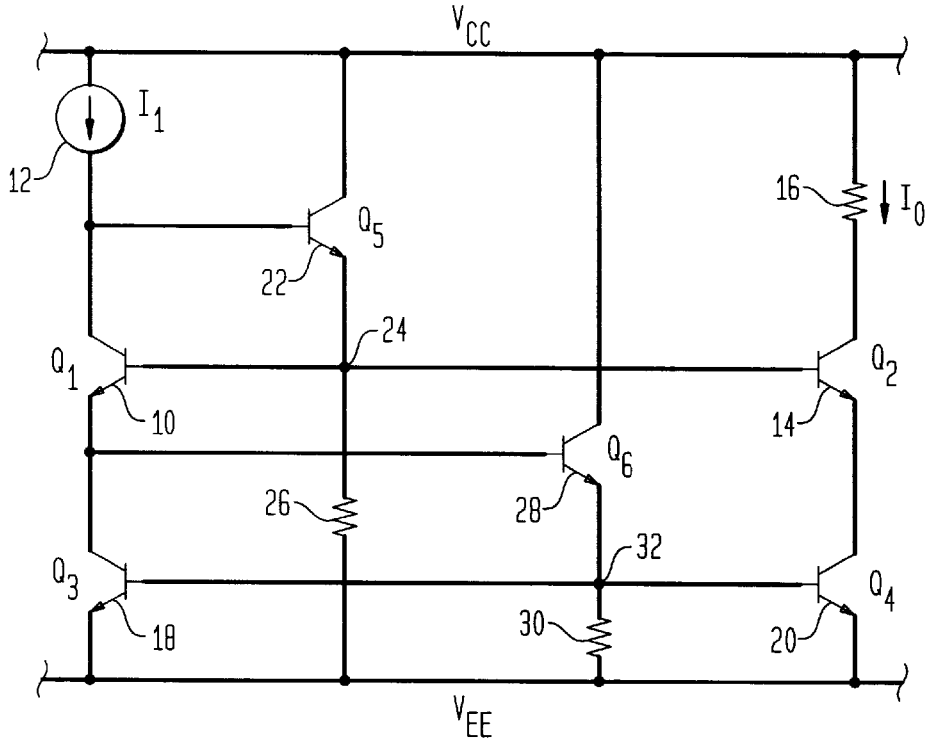
FIG. 4A (PRIOR ART)
FIGS. 4A and 4B are electrical schematic diagrams illustrative of conventional complementary type cascoded current mirror circuits also including beta helper circuitry.
Figure 4B:
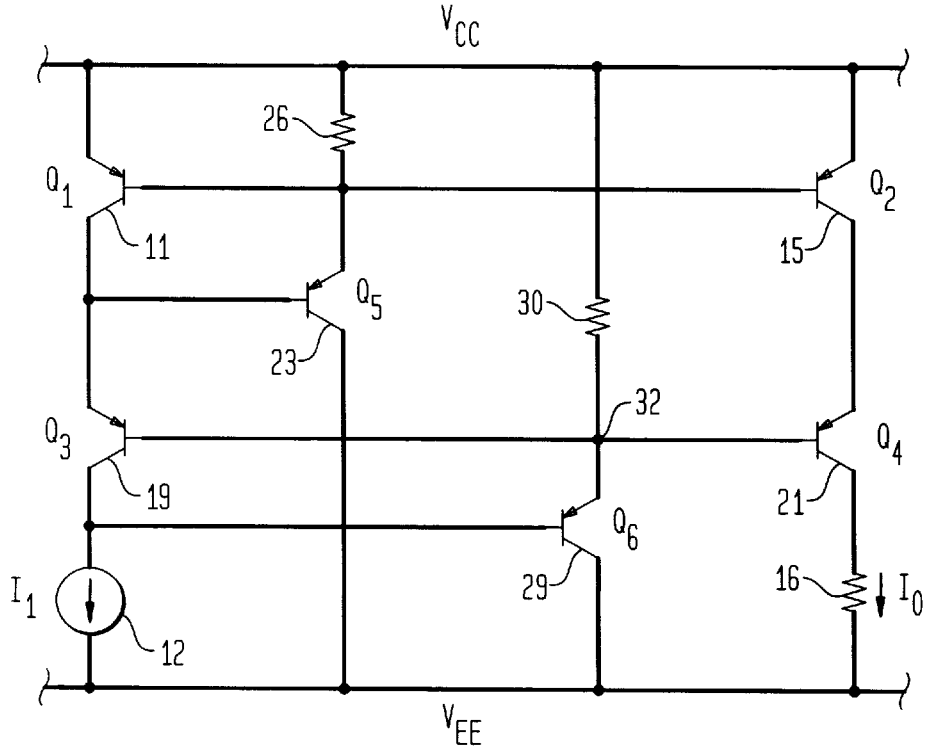
FIG. 4B (PRIOR ART)

The same conditions apply with respect to the npn and pnp cascoded current mirror circuits with beta helper circuitry such as shown in FIGS. 4A and 4B. In the circuitry shown in FIGS. 4A and 4B, there is provided a second beta helper circuit which includes transistor Q6 which in the npn configuration, comprises the transistor 28, while in the pnp configuration, comprises the transistor 29. As with the beta helper transistor Q5 shown in FIG. 4A, the emitter of Q6 is, commonly connected to the base electrodes of transistors Q3 and Q4 at circuit node 32 as well as being returned to the voltage supply rail $V_{ee}$ via resistor 30. However, in the pnp implementation of FIG. 4B, emitter resistor 30 is now returned to the $V_{cc}$ rail. Beta helpers in the cascoded embodiment limit the voltage swing across the $I_0$ load element 16.

This now leads to a consideration of the embodiments of the subject invention which involves the addition of an emitter follower to the beta helper circuitry of FIGS. 3A, 3B and 4A, 4B and which operates to restore a $V_{be}$ of voltage compliance to the circuitry. A simple current mirror configuration of such a circuit is shown in FIGS. 5A and 5B and comprise npn and pnp implementations of the same circuit.

Figure 5A:
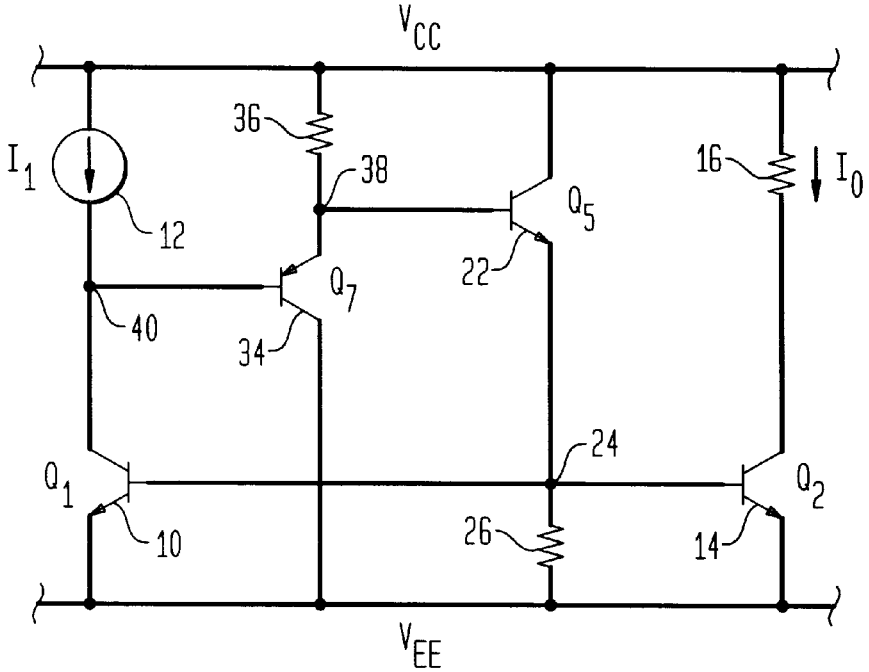
FIGS. 5A and 5B are electrical schematic diagrams illustrative of complementary type simple current mirror circuits with beta helper circuitry and an emitter follower in accordance with one embodiment of the subject invention.

Considering now FIG. 5A, an emitter follower circuit including transistor Q7, consisting of a pnp transistor 34, the emitter of which is coupled to the base of the beta helper transistor Q5 shown consisting of the transistor 22. An emitter resistor 36 for transistor Q7 is connected to the $V_{cc}$ rail at circuit node 38. The collector of the transistor Q7 is connected directly to the $V_{ee}$ rail. The base of the pnp transistor Q7 is connected to the collector of transistor Q1 and the current source 12.

It is to be noted that the transistors Q1, Q2, and Q5 are comprised of npn transistors 10, 14 and 22, whereas the emitter follower transistor Q7 comprises a transistor 34 of opposite semiconductivity i.e. a pnp transistor. The transistor Q7, in effect, acts as a level shifter to provide a compensating $V_{be}$ to circuit node 38 so as to improve the voltage swing of $I_1$ at circuit node 40.

Figure 5B:
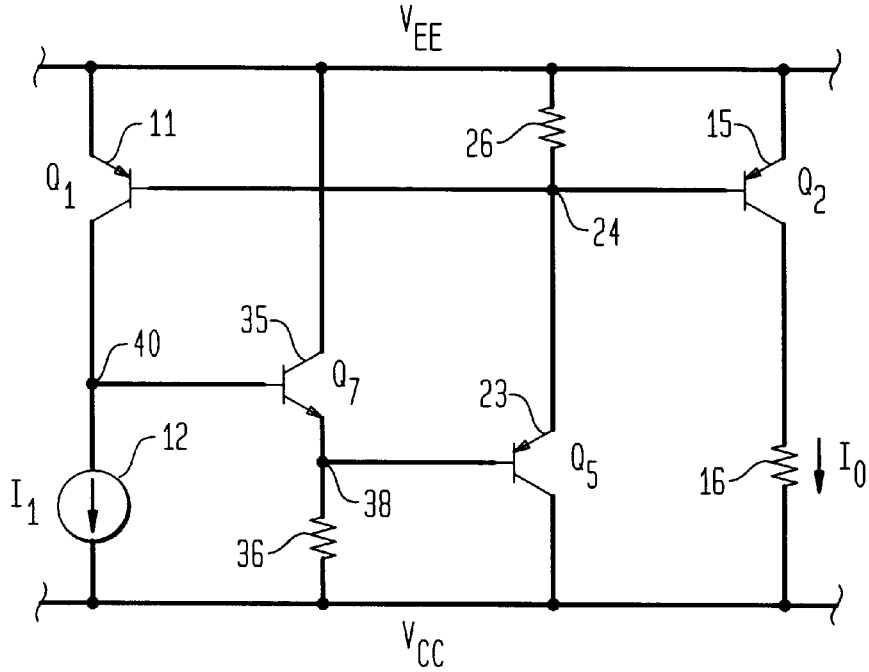

In the complementary circuit configuration of FIG. 5B, transistors Q1, Q2 and Q5 are comprised of the pnp transistors 11, 15, and 23, respectively. Now, however, the emitter follower transistor Q7 comprises a npn transistor 35, with the emitter electrode now being returned to the $V_{ee}$ rail by means of emitter resistor 36.

The concept of adding an emitter follower circuit for restoring a $1V_{be}$ of voltage compliance for enhancing the head room requirement, was conceived primarily for use in connection with a cascoded current mirror circuit that uses beta helpers. Accordingly, the complementary npn and pnp embodiments shown in FIGS. 6A and 6B disclose the preferred embodiments of the invention.

Figure 6B:
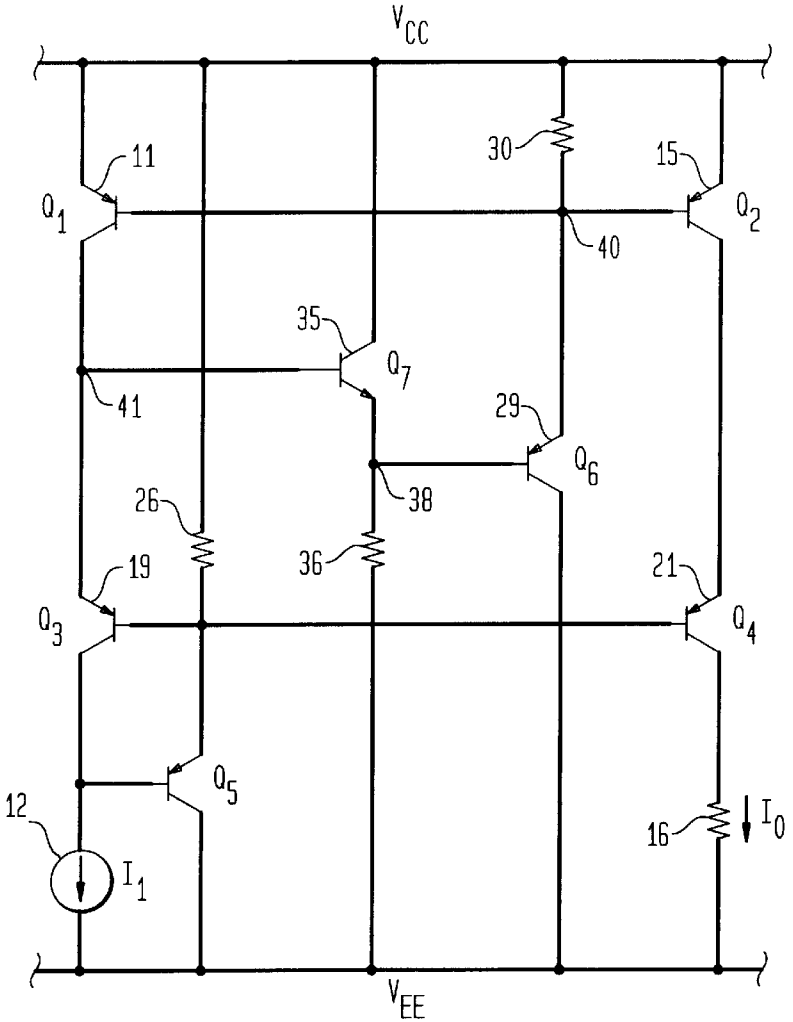
FIGS. 6A and 6B are electrical schematic diagrams illustrative of complementary type cascoded current mirror circuits with both beta helper circuitry and circuitry in accordance with the preferred embodiment of the subject invention.
Figure 6A:
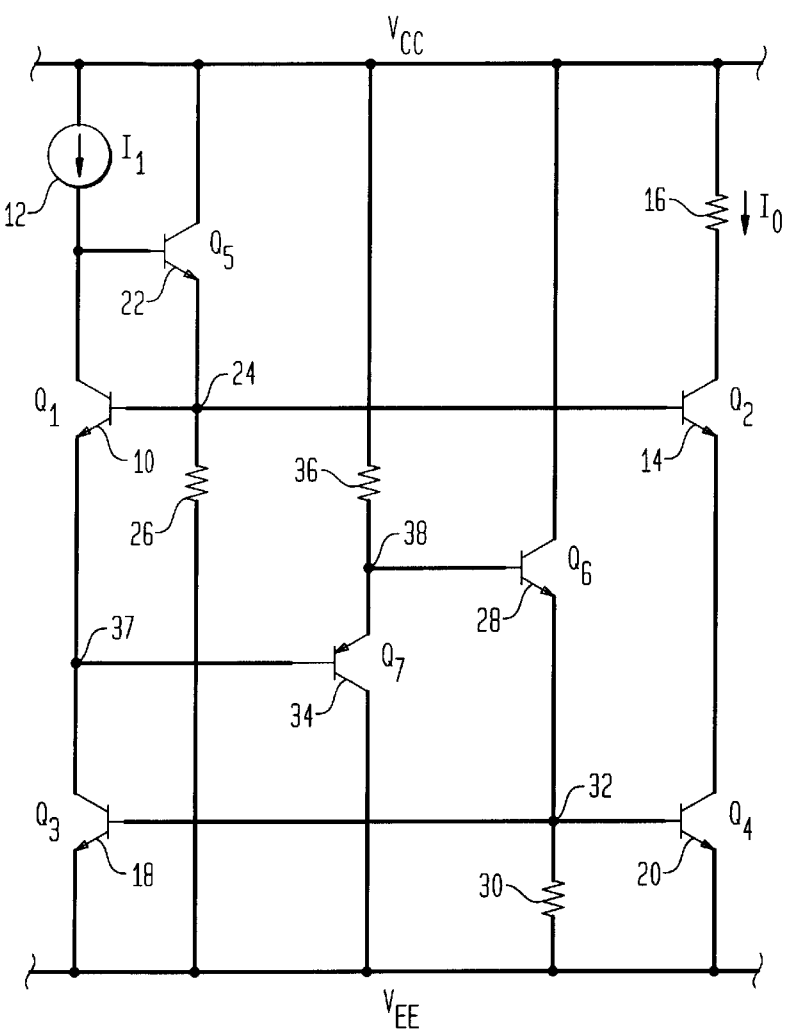

With respect to the npn embodiment shown in FIG. 6A, it is similar to the cascoded current mirror with beta helper circuit configuration shown in FIG. 4A; however, it now additionally includes an emitter follower transistor Q7 consisting of a pnp transistor 34 located in front of beta helper transistor Q6. In this regard, the base of Q7 is connected to circuit node 37, which is common to the series interconnection of the emitter of Q1 and the collector of Q3. Furthermore, the emitter of emitter follower transistor Q7 is directly connected in a voltage follower circuit relationship to the base of Q6 and is returned from circuit node 38 to the $V_{cc}$ rail via resistor 36. The collector of the emitter follower transistor Q7 is connected directly to the $V_{ee}$ rail which is noted heretofore as also capable of being at zero or ground potential.

This circuit configuration results in a $1V_{be}$ (base to emitter) voltage drop at circuit node 32 which is caused by the base-emitter junction of transistor Q3. The beta helper transistor Q6, however, results in a $2V_{be}$ voltage drop at circuit node 38 which is common to the emitter of Q7 and the base of Q6. The presence of the transistor Q7 now acts as a level shifter, restoring a $1V_{be}$ of voltage compliance to circuit node 37, whereas in the configuration of FIG. 4A, the voltage at circuit node 24 would be $V_{ee}+3V_{be}$ resulting in $I_0$ not being able to be lower than this or else transistor Q2 saturates. With the inclusion of the transistor Q7 as shown in FIG. 6A, $I_0$ can pull down to $V_{ee}+2V_{be}$, thus reducing the head room requirement by $1V_{be}$.

Turning attention now to the pnp embodiment as shown in FIG. 6B, the same circuit relationship exists; however, the emitter follower transistor Q7 now comprises an npn transistor 35 whose base is connected to circuit node 41 between the collector of Q1 and the emitter of Q3. The collector of the emitter follower transistor Q7 is now connected to the $V_{cc}$ rail. The emitter is directly connected to base of Q6. Emitter load resistor 36 is connected to the $V_{ee}$ rail at circuit node 38. Further as shown in FIG. 6B, the pnp beta helper transistor Q6 has its collector connected directly to the $V_{ee}$ rail, while the emitter is connected to circuit node 40, which is common to the base electrodes of transistors Q1 and Q2, and further returned to the $V_{cc}$ supply rail via resistor 30.

Thus what has been shown and described is a cascoded current mirror circuit which includes an emitter follower to restore a $V_{be}$ of voltage compliance to a circuit that also uses beta helpers which operate to reduce the mirror error due to base currents. Such a configuration, in particular, allows the use of a cascoded current mirror circuit, in applications where it could not normally be used due to voltage compliance problems.

Having thus shown and described what is at present considered to be the preferred embodiments of the invention, it should be noted that the same has been made by way of illustration and not limitations. Accordingly, all modifications, alterations and changes coming within the spirit and scope of the invention as set forth in the appended claims, are herein meant to be included.

I claim:

1. A semiconductor current source, comprising:

at least two semiconductor devices, having first and second current conducting electrodes and a control electrode, connected together in a current mirror circuit configuration wherein the control electrodes thereof are commonly connected together, the first current conducting electrodes being directly connected to a first supply voltage terminal and the second current conducting electrodes being connected to a second supply voltage terminal through respective electrical impedance elements for providing a reference or input current through one of said semiconductor devices and an output current through the other of said semiconductor devices and wherein the reference or input current and the output current mirror each other and have a constant ratio;

a third and a fourth semiconductor device, each having first and second current conducting electrodes and a control electrode, connected between said at least two semiconductor devices to improve the voltage compliance thereof, wherein the control electrode of the third semiconductor device is connected to the second current conducting electrode of said one semiconductor device, one of said first and second current conducting electrodes of the third semiconductor device is directly connected to the first supply voltage terminal, and the other of said first and second current conducting electrodes of said third semiconductor device is connected to the second supply voltage terminal through a load impedance and directly to the control electrode of the fourth semiconductor device, and wherein one of said first and second current conducting electrodes of the fourth semiconductor device is directly connected to the second supply voltage terminal and the other of said first and second current conducting electrodes of the fourth semiconductor device is connected to the first supply voltage terminal through a load impedance and directly to the control electrodes of said at least two semiconductor devices.

2. A semiconductor current source according to claim 1 wherein said at least two semiconductor devices and said fourth semiconductor device comprise first semiconductivity type devices and said third semiconductor device comprises a second semiconductivity type device.

3. A semiconductor current source according to claim 2 wherein all of said semiconductor devices comprise junction or field effect transistors which are implemented in an integrated circuit.

4. A semiconductor current source according to claim 3 wherein said at least two transistors and said fourth transistor comprise npn transistors and said third transistor comprises a pnp transistor.

5. A semiconductor current source according to claim 3 wherein said at least two transistors and said fourth transistor comprise pnp transistors and said third transistor comprises an npn transistor.

6. A semiconductor current source according to claim 2 wherein said at least two semiconductor devices comprise two pairs of cascoded semiconductor devices connected in a cascoded mirror circuit configuration across said first and second supply voltage terminals.

7. A semiconductor current source according to claim 6, said third semiconductor device comprises an emitter follower transistor and said fourth semiconductor device comprises a beta helper transistor.

8. A semiconductor current source according to claim 7 wherein said two pairs of cascoded transistors and said beta helper transistor comprise npn transistors, said emitter follower transistor comprises a pnp transistor, said first supply voltage terminal comprises a terminal for a $V_{ee}$ supply voltage or ground and said second supply voltage terminal comprises a terminal for a $V_{cc}$ supply voltage.

9. A semiconductor current source according to claim 7 wherein said two pairs of cascoded transistors and said beta helper transistor comprise pnp transistors and said emitter follower transistor comprises an npn transistor, said first supply voltage terminal comprises a terminal for a $V_{cc}$ supply voltage and said second supply voltage terminal comprises a terminal for a $V_{ee}$ supply voltage or ground.

10. A cascoded current mirror circuit having an improved voltage compliance, comprising:

an input current pair and an output current pair of cascoded transistors, each including series connected impedance elements, being connected in parallel across a source of supply voltage and having mutually opposing control electrodes commonly connected together and respectively providing an input current which acts as a reference current and an output current and wherein the reference current and output current mirror each other;

a pair of beta helper circuits including a transistor respectively coupled across one transistor of said pairs of cascoded transistors for reducing mirror error due to base or gate currents; and a voltage follower circuit including a transistor coupled between said transistors of said input pair of cascoded transistors and one transistor of the beta helper circuit of the output current pair for restoring a measure of voltage compliance to the output current of the mirror circuit.

11. A cascoded current mirror circuit according to claim 10 wherein said pair of cascoded transistors, said pair of beta helper circuits and said voltage follower circuit are included in an integrated circuit structure.

12. A cascoded current mirror circuit according to claim 10 wherein the transistors of said pairs of cascoded transistors and said transistors of the beta helper circuits comprise transistors of a first semiconductivity type and the transistor of the voltage follower circuit comprises a transistor of a second semiconductivity type.

13. A cascoded current mirror circuit according to claim 12 wherein said voltage follower circuit comprises an emitter or source follower circuit.

14. A cascoded current mirror circuit according to claim 12 wherein all of said transistors comprise junction or field effect transistors which are included in an integrated circuit structure.

15. A cascoded current mirror circuit according to claim 12 wherein said first semiconductivity type comprise npn semiconductivity and the second semiconductivity type comprises pnp semiconductivity.

16. A cascoded current mirror circuit according to claim 12 wherein said first semiconductivity type comprises pnp semiconductivity and said second semiconductivity type comprises npn semiconductivity.

17. A cascoded current mirror circuit providing an improved voltage compliance on an output signal, comprising:

an input current pair and an output current pair of cascoded semiconductor devices, each said pair including series connected impedance elements, being connected in parallel across a source of supply voltage, where control electrodes of the input current pair of cascoded semiconductor devices are connected across to like control electrodes of the output current pair of cascoded semiconductor devices and respectively providing an input current which acts as a reference current and an output current and wherein the reference current and output current mirror each other;

a pair of beta helper circuits including a semiconductor device respectively coupled across one semiconductor device of both said pairs of cascoded semiconductor devices for reducing mirror error due to control currents; and a voltage follower circuit including a semiconductor device coupled between said input current pair of cascoded semiconductor devices and said semiconductor device of the beta helper circuit coupled across one of said output current pair of cascoded semiconductor devices of said output current pair of cascoded semiconductor devices for restoring a measure of voltage compliance to the output signal of the current mirror circuit.

18. A cascoded current mirror circuit providing an improved voltage compliance on an output signal, comprising:

an input current pair and an output current pair of cascoded transistors, each said pair including series connected impedance elements, being connected in parallel across a source of supply voltage and having mutually opposing control electrodes commonly connected together and respectively providing an input current which acts as a reference current and an output current and wherein the reference current and output current mirror each other;

a pair of beta helper circuits including a respective transistor coupled across one transistor of both said pair of cascoded transistors for reducing mirror error due to base or gate currents; and a voltage follower circuit including a transistor coupled between said input current pair of cascoded transistors and said transistor of the beta helper circuit coupled across one of said output current pair of cascoded transistors of said output current pair of cascoded transistors for restoring a measure of voltage compliance to the output signal of the current mirror circuit.

19. A cascoded current mirror circuit according to claim 18 wherein said pairs of cascoded transistors, said pair of beta helper circuits and said voltage follower circuit are included in an integrated circuit structure.

20. A cascoded current mirror circuit according to claim 18 wherein the transistors of said pairs of cascoded transistors and said transistors of the beta helper circuits comprise transistors of a first semiconductivity type and the transistor of the voltage follower circuit comprises a transistor of a second semiconductivity type.

21. A cascoded current mirror circuit according to claim 20 wherein said voltage follower circuit comprises an emitter or source follower circuit.

22. A current mirror circuit, comprising:

an input current pair and an output current pair of cascoded semiconductor devices, said semiconductor devices having first and second current conducting electrodes and a control electrode, and connected together in a current mirror circuit configuration, wherein the control electrodes of said input pair of semiconductor devices are connected to respective control electrodes of the output pair of semiconductor devices, wherein one current conducting electrode of one semiconductor device of both said pairs of cascoded semiconductor devices are directly connected to a first supply voltage terminal and the other current conducting electrode of the other semiconductor device of both said pairs of current conducting electrodes are connected to a second supply voltage terminal through respective electrical impedance elements so as to provide a reference or input current through said input current pair of semiconductor devices and an output current through said output current pair of semiconductor devices and wherein the reference or input current and the output current mirror each other and have a constant ratio;

a first and second impedance element respectively connected between the commonly connected control electrodes of said pairs of input current and output current cascoded semiconductor devices and said first supply voltage terminals, a third and a fourth semiconductor device, each having first and second current conducting electrodes and a control electrode, respectively connected to one semiconductor device of said pairs of semiconductor devices in beta helper circuit relationship therewith, wherein the control electrode of the third semiconductor device is connected to one current conducting electrode of one semiconductor device of said input current pair of semiconductor devices, one of said first and second current conducting electrodes of the third semiconductor device is connected to the second supply voltage terminal, and the other of said first and second current conducting electrodes of said third semiconductor device is connected to the first impedance element and the control electrode of said one semiconductor device of said input current pair, wherein the control electrode of the fourth semiconductor device is connected to one current conducting electrode of one semiconductor device of said output current pair of semiconductor devices, one of said first and second current conducting electrodes of the fourth semiconductor device is connected to the first supply voltage terminal, and the other of said first and second current conducting electrodes of said fourth semiconductor device is connected to the second impedance element and the control electrode of said one semiconductor device of said output current pair; and a fifth semiconductor device having first and second current conducting electrodes and a control electrode connected in voltage follower circuit relationship between the input current pair of semiconductor devices and said fourth semiconductor device connected in beta helper circuit relationship to said semiconductor device of the output current pair, wherein the control electrode of the fifth semiconductor device is connected to commonly connected current conducting electrodes of the input current pair of semiconductor devices, one of said first and second current conducting electrodes is directly connected to the first supply voltage terminal, and the other of said first and second current conducting electrodes is connected to control electrode of the fourth semiconductor and to an impedance element commonly connected to the second supply voltage terminal, said fifth semiconductor device restoring a $V_{be}$ of voltage compliance to the output current pair of semiconductor devices.

23. The circuit mirror circuit according to claim 22 wherein all of said semiconductor devices are comprised of transistors.

24. The current mirror circuit according to claim 23 wherein said transistors are included in an integrated circuit structure.

25. A cascoded current mirror circuit according to claim 23 wherein the transistors of said pairs of input current and output current of cascoded transistors and said third and fourth beta helper transistors comprise transistors of a first semiconductivity type and the fifth transistor of the voltage follower circuit comprises a transistor of a second semiconductivity type.

26. A cascoded current mirror circuit according to claim 25 wherein said voltage follower comprises an emitter or source follower.

27. A cascoded current mirror circuit according to claim 25 wherein all of said transistors comprise junction or field effect transistors which are included in an integrated circuit structure.

28. A cascoded current mirror circuit according to claim 25 wherein said first semiconductivity type comprise npn semiconductivity and the second semiconductivity type comprises pnp semiconductivity.

29. A cascoded current mirror circuit according to claim 25 wherein said first semiconductivity type comprises pnp semiconductivity and said second semiconductivity type comprises npn semiconductivity.

30. A method of restoring a $V_{be}$ of voltage compliance to a cascoded current mirror circuit, comprising:

(a) connecting respective impedance elements in series with an input current pair and an output current pair of cascoded transistors;

(b) connecting said pairs of cascoded transistors and the respective series connected impedances in parallel across a source of supply voltage;

(c) commonly connecting control electrodes of first transistors of said pairs of cascoded transistors and commonly connecting control electrodes of second transistors of said pairs of cascoded transistors so as to provide an input current which acts as a reference current and an output current which is a current mirror of the input current;

(d) connecting a pair of beta helper circuits including respective transistors respectively across one transistor of said pairs of cascoded input current and output current transistors for reducing mirror error due to base or gate current supplied thereto; and (e) connecting a voltage follower circuit including a transistor between the input current pair of cascoded transistors and the transistor of the beta helper circuit coupled across one transistor of the output current pair of cascoded transistors for restoring a measure of voltage compliance to the mirror circuit.

31. A method according to claim 30 wherein the input current pair and the output current pair of cascoded transistors, the beta helper circuits and voltage follower circuit are comprised of bipolar or field effect transistors and wherein the voltage follower circuit comprises an emitter or source follower circuit.

32. A method according to claim 30 wherein the emitter or source follower circuit includes a transistor having a semiconductivity type opposite to the semiconductivity type of transistors included in the pairs of cascoded transistors and the beta helper circuits.

* * * * *